US008507055B2

(12) United States Patent
Katampe

(10) Patent No.: US 8,507,055 B2
(45) **Date of Patent: *Aug. 13, 2013**

(54) LASER OR DYE SUBLIMATION PRINTABLE IMAGE TRANSFER PAPER

(75) Inventor: Ibrahim Katampe, Kettering, OH (US)

(73) Assignee: Iya Technology Laboratories, LLC, Kettering, OH (US)

( * ) Notice: Subject to any disclaimer, the term of this patent is extended or adjusted under 35 U.S.C. 154(b) by 111 days.

This patent is subject to a terminal disclaimer.

(21) Appl. No.: 12/947,011

(22) Filed: Nov. 16, 2010

(65) Prior Publication Data

US 2011/0111145 A1 May 12, 2011

Related U.S. Application Data

(63) Continuation-in-part of application No. 11/950,608, filed on Dec. 5, 2007.

(60) Provisional application No. 60/873,684, filed on Dec. 8, 2006.

(51) Int. Cl.
*B41M 5/40* (2006.01)

(52) U.S. Cl.
USPC ..... 428/32.72; 428/32.82; 428/32.84

(58) Field of Classification Search
USPC ..... 428/32.52, 32.8–32.82, 32.72, 32.84; 503/227
See application file for complete search history.

(56) References Cited

U.S. PATENT DOCUMENTS 3,516,842 A * 6/1970 Klinke, Jr. et al. ..... 428/40.5
4,224,358 A 9/1980 Hare
4,235,657 A 11/1980 Greenman et al.
4,284,456 A 8/1981 Hare
4,555,436 A * 11/1985 Geurtsen et al. ..... 428/200
4,737,485 A 4/1988 Henzel et al.
4,773,953 A 9/1988 Hare
4,778,782 A * 10/1988 Ito et al. ..... 503/227
4,863,781 A 9/1989 Kronzer
4,966,815 A 10/1990 Hare
4,980,224 A 12/1990 Hare
5,124,309 A * 6/1992 Egashira ..... 503/227
5,242,739 A 9/1993 Kronzer et al.
5,271,990 A 12/1993 Kronzer et al.
5,294,589 A * 3/1994 Egashira ..... 503/227

(Continued)

FOREIGN PATENT DOCUMENTS

EP 0988991 3/2000
WO 2004/050262 6/2004

OTHER PUBLICATIONS

PCT, International Search Report and Written Opinion, International Application No. PCT/US2007/086466 (May 20, 2008).

(Continued)

*Primary Examiner* — Gerard Higgins
*Assistant Examiner* — Sathavaram I Reddy
(74) *Attorney, Agent, or Firm* — Thompson Hine, L.L.P.

(57) ABSTRACT

An image transfer paper including a substrate layer, an image layer positioned relative to the substrate layer, the image layer including at least one of a polyester and a polyurethane and at least one of a micronized polytetrafluoroethylene and a micronized polyethylene, and a release layer positioned between the substrate layer and the image layer, the release layer including a wax component and at least one of a fluoro phosphate ester and a perfluoro phosphate ester.

16 Claims, 2 Drawing Sheets

(56) References Cited

U.S. PATENT DOCUMENTS

| | | | | |
|---|---|---|---|---|
| 5,294,590 | A | 3/1994 | Egashira et al. | |
| 5,350,732 | A * | 9/1994 | Kosydar et al. | 503/227 |
| 5,376,618 | A | 12/1994 | Uytterhoeven et al. | |
| 5,457,000 | A | 10/1995 | Defieuw et al. | |
| 5,501,902 | A | 3/1996 | Kronzer | |
| 5,521,142 | A * | 5/1996 | Landgrebe et al. | 503/227 |
| 5,798,179 | A | 8/1998 | Kronzer | |
| 5,837,649 | A | 11/1998 | Nozaki | |
| 5,922,159 | A | 7/1999 | Cahill | |
| 5,945,375 | A | 8/1999 | Kronzer | |
| 6,113,725 | A | 9/2000 | Kronzer | |
| 6,200,668 | B1 | 3/2001 | Kronzer | |
| 6,224,964 | B1 | 5/2001 | Kawai et al. | |
| 6,265,053 | B1 | 7/2001 | Kronzer et al. | |
| 6,450,633 | B1 | 9/2002 | Kronzer | |
| 6,497,781 | B1 | 12/2002 | Dalvey et al. | |
| 6,551,692 | B1 | 4/2003 | Dalvey et al. | |
| 6,695,446 | B2 | 2/2004 | Sato et al. | |
| 6,758,932 | B2 | 7/2004 | Yamamoto et al. | |
| 6,800,589 | B2 | 10/2004 | Wachi et al. | |
| 6,869,910 | B2 | 3/2005 | Williams et al. | |
| 6,878,227 | B2 | 4/2005 | Xu et al. | |
| 6,878,423 | B2 * | 4/2005 | Nakanishi | 428/32.12 |
| 6,890,623 | B2 | 5/2005 | Onishi et al. | |
| 6,916,751 | B1 | 7/2005 | Kronzer | |
| 6,946,425 | B2 | 9/2005 | Yamamoto et al. | |
| 6,951,671 | B2 | 10/2005 | Mukherjee et al. | |
| 7,026,024 | B2 | 4/2006 | Chang et al. | |
| 2002/0160205 | A1 | 10/2002 | Garcia et al. | |
| 2004/0221945 | A1 | 11/2004 | Williams et al. | |

OTHER PUBLICATIONS

PCT, International Preliminary Report on Patentability, International Application No. PCT/US2007/086466 (Jun. 18, 2009).

* cited by examiner

LASER OR DYE SUBLIMATION PRINTABLE IMAGE TRANSFER PAPER

CROSS REFERENCE TO RELATED APPLICATIONS

The present patent application is a continuation-in-part of U.S. Ser. No. 11/950,608 filed on Dec. 5, 2007, which claims priority from U.S. Ser. No. 60/873,684 filed on Dec. 8, 2006, the entire contents of which are hereby incorporated herein by reference.

FIELD

The present application relates to transfer paper and, more particularly, to non-silicon heat transfer paper that can be printed with laser printers or copiers or by dye sublimation to provide an image that can be transferred to a paper, film or textile.

BACKGROUND

Transfer papers have been used to transfer images from the transfer paper to a receiving substrate. For example, a user may transfer an image printed on a transfer paper to a garment or non porous substrate such as ceramics or plastics. Once the transfer paper has reached the required temperature, the image on the transfer paper will transfer onto the garment or the non-porous substrate such as ceramics.

Prior art transfer papers have presented disadvantages, including cracking of the image after the image has been transferred to the garment and the inability to directly transfer images on an un-treated non-porous surface. Therefore, there is a need for an improved image transfer paper that can be printed using a laser copier or printer, dye sublimation or even using a marker device and the subsequent image can be transferred unto a fabric without cracking or directly unto a non-porous surface without any surface pre-treatment.

SUMMARY

In one aspect, the disclosed image transfer paper may include a substrate layer, an image layer positioned relative to the substrate layer, the image layer including at least one of a polyester and a polyurethane and at least one of a micronized polytetrafluoroethylene and a micronized polyethylene, and a release layer positioned between the substrate layer and the image layer. In one embodiment, the release layer includes a wax component and at least one of a fluoro phosphate ester and a perfluoro phosphate ester.

In another aspect, the disclosed image transfer paper may include a substrate layer, an image layer positioned relative to the substrate layer, the image layer including at least one of a polyester and a polyurethane and at least one of a polytetrafluoroethylene and a polyethylene dispersed in the polyester and/or polyurethane, and a release layer positioned between the substrate layer and the image layer, the release layer including a wax component and at least one fluorosurfactant such as a fluoro phosphate ester and a perfluoro phosphate ester.

In another aspect, the disclosed image transfer paper may include a substrate layer and an image layer positioned relative to the substrate layer, the image layer including a wax component, at least one fluorosurfactant such as a fluoro phosphate ester and a perfluoro phosphate ester, and a dispersion of at least one of a polytetrafluoroethylene and a polyethylene in at least one of a polyester and a polyurethane.

Other aspects of the disclosed image transfer paper will become apparent from the following description, the accompanying drawings and the appended claims.

DETAILED DESCRIPTION

Figure 1:
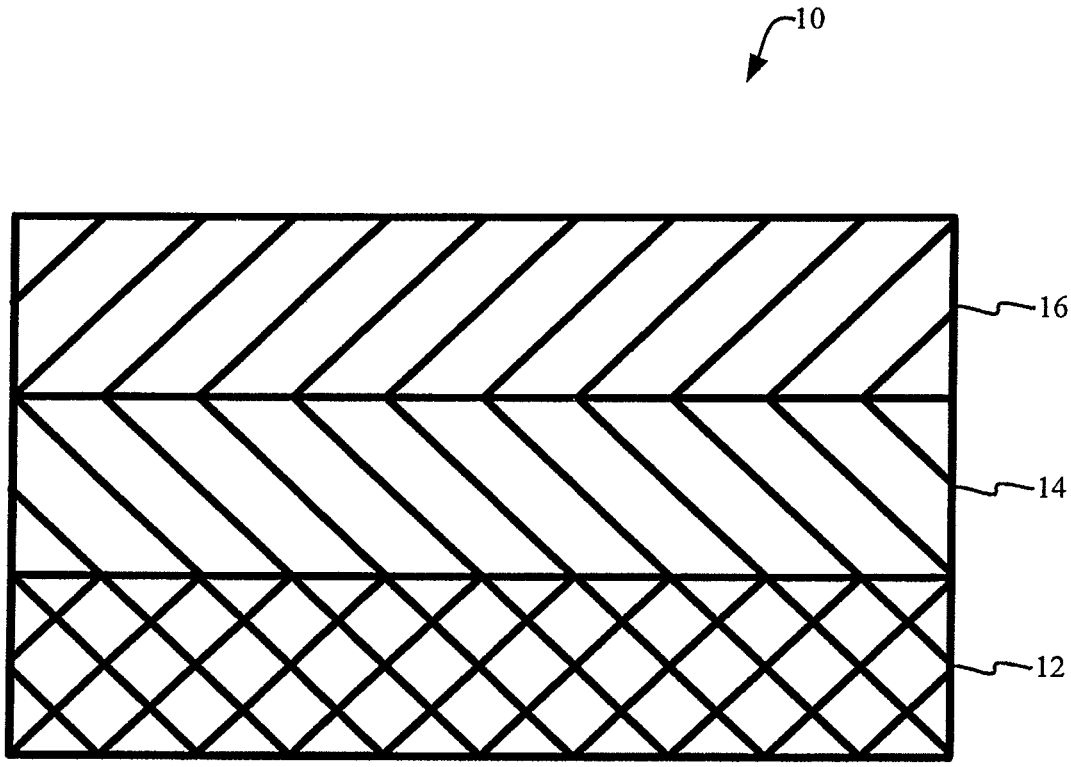
FIG. 1 is a cross-sectional view of a first aspect of the disclosed image transfer paper.

Referring to FIG. 1, a first aspect of the disclosed image transfer paper, generally designated 10, may include a substrate layer 12, a release layer 14 and an image layer 16, wherein the release layer 14 is positioned between the substrate layer 12 and the image layer 16. While the designation "image transfer paper 10" used herein includes the word "paper," the disclosed image transfer paper 10 does not necessarily require or include actual paper as a component thereof.

The image transfer paper 10 may be capable of producing images on both synthetic and non-synthetic receiving substrates (e.g., t-shirts) (not shown) that exhibit similar hot and cold peel characteristics resulting in images that do not crack, are stretchable, and can be transferred directly unto treated or an un-pretreated non-porous substrate.

Substrate Layer

The substrate layer 12 may be formed from or may include any suitable material. For example, the substrate layer 12 may be formed from or may include various papers or paperboard materials, such as synthetic paper (e.g., polyolefin or polystyrene-based paper), fine paper, art paper, coated paper, cast coated paper, wall paper, backing paper, synthetic resin or emulsion impregnated paper, synthetic rubber latex impregnated paper, synthetic resin intercalated paper, paperboard and cellulose fiber paper. The substrate layer 12 may also be formed from or may include various plastic materials and films or sheets of such plastic materials, including, for example, polyolefin, polyvinyl chloride, polyethylene terephthalate, polystyrene, polymethacrylate and polycarbonate. Substrate layer 12 may also be formed from or may include white, opaque films or foamed sheets formed from appropriate synthetic resins to which white pigments and fillers may be added.

Those skilled in the art will appreciate that the substrate layer 12 may be also formed from multiple sheets or layers that have been laminated together in any desired combination. Examples of appropriate laminates include combined cellulose fiber paper/synthetic paper and combined cellulose fiber paper/plastic films or sheets.

Furthermore, the substrate layer 12 may be coated, uncoated, calendered, C1S, C2S or the like. In one aspect, the substrate layer 12 may be coated with a primer to improve adhesion of the release layer 14 to the substrate layer 12. In one embodiment, the substrate layer is C1S clay coated paper having a basis weight of 50-80 pounds per ream. In another aspect, a surface of the substrate layer 12 may be corona discharge treated to improve adhesion.

Release Layer

The release layer 14 is formed of a layer that will permit the image layer to be transferred from the substrate layer 12 under the conditions described herein. In one embodiment, the release layer 14 may be a blend including a wax component and a fluoro and/or perfluoro phosphate ester component. In one embodiment, the blend may be an aqueous polymer blend or latex and the resulting release layer 14 may be non-film forming. In one aspect, the release layer 14 may be applied to the substrate layer 12 as a water-based emulsion without a barrier layer.

The wax component of the release layer 14 may be a natural wax or a synthetic wax and may be crystalline, non crystalline or semi-crystalline in nature. Examples of potentially useful wax components include various thermoplastic resin oligomers such as polyurethane, polystyrene, polyester, polyacrylic, polyethylene, ethylene, polyvinyl chloride, polyvinyl acetate, ethylene/vinyl acetate copolymer, ethylene/acrylic copolymer, polyoxyethylene, polyoxypropylene and polyoxyethylene-propylene oligomers; fatty acids such as myristic, palmitic, margaric, stearic, arachic and montanic acids; fatty acid amides such as caproic, caprylic, lauric, stearic, oleic and eicosanic acid amides; fatty acid esters such as methyl behenate, methyl lignocerate, methyl montanate, pentadecyl palmitate, hexacosyl stearate and carbamic acid [1,4-phenylenebis-(methylene)]bisdimethyl ester; aromatic compounds such as 1,4-dicyclohexylbenzene, benzoic acid, aminobenzophenone, dimethyl terephthalate, fluoranthene, phenols, naphthalenes and phenoxies; and various other waxes. In one embodiment the wax is present in the emulsion used to form the release layer in an amount of about 5 to 25% by weight.

The fluorosurfactant may be a fluoro or perfluoro phosphate ester or combinations of fluoro and/or perfluoro phosphate esters. In one embodiment the phosphate ester is NOVEC FC4200, a fluoro aliphatic polymeric ester available from 3M Company. In one embodiment the fluorosurfactant is present in the emulsion used to form the release layer in an amount of about 0.5 to 5% by weight.

Image Layer

The image layer 16 may be coated or otherwise applied to the release layer 14 and may include a blend of polymers, copolymers and/or resins and may provide a non-film forming, non-continuous layer. The image layer is designed so that it does not melt upon contact with the toner drum in a laser printer. The image layer may soften but it should not soften to the point that it sticks to the printer drum. In one embodiment the image layer has a Tg in the range of about 120 to 325° C., and in another embodiment the image layer has a Tg about 200 to 325° C.

The image layer may be applied to the release layer in an amount of about 2.5 to 15 pounds per ream.

In one embodiment, the image layer 16 may include a first resin (1) polyester and/or polyurethane and a second resin (2) a polytetrafluoroethylene, polypropylene and/or polyethylene one or both of which may be micronized. In one embodiment one or both of the resins have a particle size of about 5 to 150 microns. The polyester and/or polyurethane may be applied to the image layer 16 as a dispersion, an emulsion or as a resin. The range and amount of Resins (1) or (2) by weight can be about 50/50 (1:2) or range from about 75/25 (Resin1: Resin2) or 25/75 by weight.

Additionally, various other resin systems may be included in the image layer 16, including polypropylene; halogenated polymers, e.g., polyvinyl chloride and polyvinylidene chloride; vinylic polymers, e.g., polyvinyl acetate, vinyl chloride/vinyl acetate copolymers, ethylene/vinyl acetate copolymers and polyacrylates; polyester type resins, e.g., polyethylene terephthalate and polybutylene terephthalate; acetal resins, e.g., polyvinyl acetacetal and polyvinyl butyral; polystyrene type resins; polyamide type resins; polyurethane resins; copolymeric resins, e.g., copolymers of olefins such as ethylene and propylene with other vinyl monomers; ionomers; cellulosic resins, e.g., cellulose diacetate and cellulose triacetate; and polycarbonates. Those skilled in the art will appreciate that the resins listed above may be used alone or in combinations of two or more.

The disclosed (co)polyester of the image layer 16 may be obtained by condensing one or more dicarboxylic acids with one or more diols including aromatic and aliphatic dicarboxylic acids and diols and including one or more of the present hydroxy-carboxylic acids containing a long chain alkyl or alkylene group. The condensation may also be carried out by using derivatives of the dicarboxylic acids in the form of their corresponding esters and/or derivatives of the diols in the form of their corresponding epoxides or in the form of their corresponding acetates.

Furthermore, the following resins may be used in addition to, or as a blend with, the (co)polyester:

1. resins having ester bonds, such as polyester resins, polyacrylic ester resins, polycarbonate resins, polyvinyl acetate resins, styrene-acrylate resins, vinyl toluene-acrylate resins and the like;
2. resins having urethane bonds, such as polyurethane resins and the like;
3. resins having amide bonds, such as polyamide resins;
4. resins having urea bonds, such as urea resins and the like; and
5. other resins having highly polar bonds, such as polycaprolactone resins, polystyrene resins, polyvinyl chloride resins, polyacrylonitrile resins and cellulose derivatives.

The resins listed above as items 1-5 may be used individually or as a mixture of two or more in combination with the (co)polyester resin.

The image layer may additionally include the following polymers, which are available as powders and/or dispersions: polyolefins: low density polyethylene (LDPE), high density polyethylenes(HDPE), Low Density polypropylenes (LDPP), High density polypropylenes (HDPP), ethylene acrylic acid (EAA), ethylene vinyl acetate (EVA), methane acrylic ethylene acrylic (MAEA), polyamide and mixtures or copolymers thereof. In one embodiment, a combination of polyethylene (PE) and polypropylene (PP) is used. It has been found particularly desirable to use a blend of low density PP and PE that provides a glass transition temperature of about 300 to 325° C. The weight ratio of PP to PE may be about 50/50 to 75/25. More particularly, in another embodiment, the imaging layer combines a polyurethane, micronized PTFE and a blend of low density PE (LDPE) and low density polypropylene.

Figure 2:
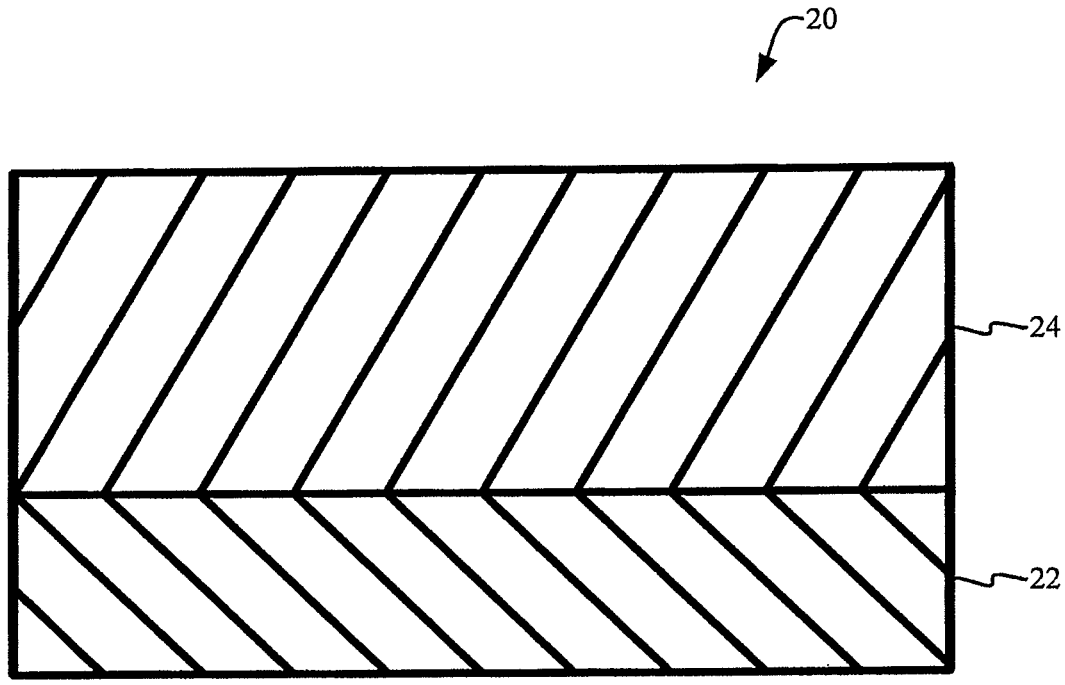
FIG. 2 is a cross-sectional view of a second aspect of the disclosed image transfer paper.

Referring to FIG. 2, a second aspect of the disclosed image transfer paper, generally designated 20, may include a substrate layer 22 and an image layer 24 containing one or more release agents. The substrate layer 22 may be formed from or may include any suitable material, such as the materials and components discussed above with respect to substrate layer 12 of FIG. 1. The image layer 24 may be a combination of the components of the release layer 14 and image layer 16 of FIG. 1. In particular, in one aspect, layer 24 may include a wax component, a fluoro and/or perfluoro phosphate ester component, polyester and/or polyurethane blend component and a micronized polytetrafluoroethylene and/or polyethylene component.

At this point, those skilled in the art will appreciate that the image layer 24 of transfer paper 20 may be a combination of the components forming the image layer 16 and release layer 14 of transfer paper 10.

Images deposited onto the disclosed image transfer paper 10 may be transferred onto various receiving substrates, while retaining a generally soft feel and remaining generally flexible and stretchable. The receiving substrates may be flexible, non flexible, synthetic, non-synthetic, and blends of synthetic and non-synthetic material. For example, the receiving substrate may be a garment formed from cotton, LYCRA® (Invista North America S.A.R.L. of Wilmington, Del.), spandex or a cotton/poly blend.

EXAMPLES

Example 1

A layered transfer paper was prepared having a substrate layer, a release layer and an image layer. The substrate layer was a C1S clay coated paper having a basis weight of 50-60 pounds per ream available from MeadWestvaco Corporation.

A release composition was prepared as combination of 25% by weight ethylene vinyl acetate copolymer (AIRFLEX) and 75% NOVEC FC4200, a fluoro aliphatic polymeric ester. The release composition was applied to the uncoated side of the substrate layer.

An image layer composition was prepared as a 75% blend of low and high density polyethylene in a weight ratio 1:1 and 25% by weight polytetrafluoroethylene dispersion in polyurethane. The image layer composition had a Tg of about 50-250° C. and was applied over the release layer at a coat weight of 10 pounds per ream to form an image layer. The resulting three layer structure was allowed to dry at room temperature.

Example 2

A layered transfer paper was prepared having a substrate layer, a release layer and an image layer. The substrate layer was an uncoated paper having a basis weight of 50-60 pounds per ream available from MeadWestvaco Corporation. A release layer containing 50% by weight AIRFLEX ethylene vinyl acetate copolymer and 50% by weight NOVEC FC4200, a fluoro aliphatic polymeric ester. The release composition was applied to the uncoated side of the substrate layer at 5 pounds per ream dry coat weight An image layer composition contains 25% by weight of a blend of low-density polyethylene/polypropylene (weight ratio 1:2) and 75% by weight polytetrafluoroethylene 35% dispersion in a DISPERCOLL polyester emulsion available from Bayer Material Science Corp. The image layer composition had a Tg of 200 to 250° C. and was applied over the release layer to form an image layer at 15 pounds per ream dry coat weight. The resulting three layer structure was allowed to dry at room temperature.

Accordingly, the disclosed transfer papers may be used to transfer images to synthetic and natural fibers and blends. The disclosed transfer papers may be made as either 2 or 3 layer structures, wherein the two-layer structure includes a blend of the release layer and image layer prior to coating. However, those skilled in the art will appreciate that additional layers may be used without departing from the scope of the present disclosure. Furthermore, the disclosed transfer papers can be constructed without using silicone resins.

Example 3

A layered transfer paper was prepared having a substrate layer an image layer. The substrate layer may be formed from or may include white, opaque films or foamed sheets formed from appropriate synthetic resins to which white pigments or fillers such as $TiO_2$, calcium carbonate or silica are added or coated there-on. An image layer composition can be prepared as a blend of 25% low density polyethylene/polypropylene at a ratio of 75/25 by weight and 75% by weight of a 35% polytetrafluoroethylene dispersion in a DISPERCOLL polyester resin emulsion. This paper can be used for transfer on dark-colored garments.

Although various aspects of the disclosed image transfer paper have been shown and described, modifications may occur to those skilled in the art upon reading the specification. The present application includes such modifications and is limited only by the scope of the claims.

What is claimed is:

1. An image transfer paper comprising:

a substrate layer;

an image layer comprising:

a) at least one of a polyester or a polyurethane;

b) at least one of a micronized polytetrafluoroethylene or a micronized polyethylene; and c) a blend of polyethylene/polypropylene, wherein said at least one of a micronized polytetrafluoroethylene or a micronized polyethylene is dispersed in said at least one of a polyester or a polyurethane; and a release layer positioned between said substrate layer and said image layer, said release layer including a wax component and a fluoro phosphate ester and/or a perfluoro phosphate ester.

2. The image transfer paper of claim 1 wherein said substrate layer includes a paper-based material.

3. The image transfer paper of claim 1 wherein said substrate layer is formed as a film.

4. The image transfer paper of claim 1 wherein said substrate layer is a laminate.

5. The image transfer paper of claim 1 wherein said substrate layer is coated.

6. The image transfer paper of claim 1 wherein said image layer further includes at least one of a polypropylene, a halogenated polymer, a vinylic polymer, an acetal resin, a polystyrene resin, a polyamide resin, an ionomer, a cellulosic resin, or a polycarbonate.

7. The image transfer paper of claim 1 wherein said at least one of said polyester and said polyurethane is applied as a dispersion or emulsion.

8. The image transfer paper of claim 1 wherein said wax component includes a thermoplastic resin oligomer, a fatty acid, a fatty acid amide, a fatty acid ester and/or an aromatic compound.

9. The image transfer paper of claim 1 wherein said wax component includes ethylene vinyl acetate.

10. The image transfer paper of claim 1 wherein said release layer is discontinuous.

11. The image transfer paper of claim 1 wherein said image layer is discontinuous.

12. The image transfer paper of claim 1 wherein said image layer and said release layer are free of silicone.

13. The image transfer paper of claim 1 wherein the substrate layer is clay-coated paper.

14. The image transfer paper of claim 1 wherein the image layer has a Tg of about 120 to 325° C.

15. The image transfer paper of claim 14 wherein the image layer has a Tg of about 200 to 325° C.

16. The image transfer paper of claim 1 wherein the image layer contains a micronized polyethylene/polypropylene blend.

* * * * *